US005672124A

United States Patent [19]

Pecoraro et al.

[11] Patent Number: 5,672,124

[45] Date of Patent: Sep. 30, 1997

[54] AUTOMATIC BATTING TEE APPARATUS

[75] Inventors: John J. Pecoraro; Michael E. Garcia, both of Pueblo, Colo.

[73] Assignee: Quick Hit, Inc., Pueblo West, Colo.

[21] Appl. No.: 753,273

[22] Filed: Nov. 22, 1996

[51] Int. Cl.[6] ..... A63B 69/40

[52] U.S. Cl. ..... 473/417; 473/136

[58] Field of Search ..... 473/132, 133, 473/134, 135, 136, 137, 417

[56] References Cited

U.S. PATENT DOCUMENTS

| | | | |
|---|---|---|---|
| 2,530,898 | 11/1950 | Hogeberg | 273/33 |
| 2,696,985 | 12/1954 | Hogeberg | 473/136 |
| 2,789,824 | 4/1957 | Willcox | 473/136 |
| 3,448,985 | 6/1969 | Scott | 473/136 |
| 3,533,631 | 10/1970 | Hladek | 473/136 |
| 3,778,067 | 12/1973 | Gentiluomo | 273/201 |
| 4,017,087 | 4/1977 | Bruno | 273/201 |
| 4,198,054 | 4/1980 | Stone | 473/134 |
| 4,355,811 | 10/1982 | Williams, Sr. | 273/201 |
| 4,815,744 | 3/1989 | Diamandis | 273/201 |
| 4,832,345 | 5/1989 | Monasco | 273/201 |
| 4,854,587 | 8/1989 | Groves | 273/26 R |
| 4,938,478 | 7/1990 | Lay | 273/26 R |
| 5,078,401 | 1/1992 | Fehrenbach et al. | 273/201 |
| 5,297,797 | 3/1994 | Lamontagne | 273/201 |
| 5,351,964 | 10/1994 | Kruger | 273/201 |
| 5,356,148 | 10/1994 | Elder | 473/133 |
| 5,386,987 | 2/1995 | Rodino, Jr. | 273/26 R |

*Primary Examiner*—Theatrice Brown

*Attorney, Agent, or Firm*—Flanagan & Flanagan

[57] ABSTRACT

An automatic batting tee apparatus includes a housing having a top opening, a chute for feeding balls one at a time to above the top opening, a drive member mounted upright in the housing for rotation about a vertical axis aligned with the top opening, and a tube disposed upright in the housing surrounding the drive member and aligned with the top opening. The tube is drivingly engaged with the drive member and coupled to the housing so that in response to rotation of the drive member in one and the other of opposite rotational directions the tube will undergo upward and downward reciprocal movement along the vertical axis relative to the rotating drive member through a ball receiving and positioning cycle. The apparatus also includes drive means for rotating the drive member in the one and other rotational directions to cause reciprocal movement of the tube through the ball receiving and positioning cycle, and drive control means for actuating the drive means to cause rotation of the drive member and reciprocal movement of the tube through the ball receiving and positioning cycle.

22 Claims, 5 Drawing Sheets

AUTOMATIC BATTING TEE APPARATUS

BACKGROUND OF THE INVENTION

1. Field of the Invention

The present invention generally relates to devices for baseball or softball practice hitting and, more particularly, is concerned with an automatic batting tee apparatus.

2. Description of the Prior Art

One of the most difficult skills to master in playing either baseball or softball is hitting the ball. The batter must be able to coordinate the swinging of the bat with the location of the ball so that good contact can be made with the ball. Also, the batter must be able to make good contact with the ball at the various positions at which it may cross homeplate in the batter's strike zone.

Good hitting takes lots of practice. A baseball tee is sometimes used to support a ball at the selected positions above homeplate. The batter then hits the ball, after which the ball is retrieved and placed back on the tee for another practice swing. In this manner, the batter can practice swinging and improve hitting skills.

Various batting tees have been developed in the past for this purpose. However, in most cases, the tees require expenditure of considerable time, motion and energy just to replace a ball on the tee before each swing. This requirement takes away from the time and energy one has available to devote to practice hitting the ball. As a result, the use of baseball practice tees has not been widely accepted.

Consequently, a need exists for improvement the batting tee so as to make it into a more effective aid to hitting practice and thus its utilization more generally acceptable.

SUMMARY OF THE INVENTION

The present invention provides an automatic batting tee apparatus designed to satisfy the aforementioned need. The automatic batting tee apparatus of the present invention alleviates drawbacks associated with prior art practice tees without introducing new ones in their place. The user of the apparatus of the present invention does not have to manually place each ball on the batting tee thereby saving a considerable amount of motion, time and energy. Instead, a number of balls are placed in a hopper or ball feeder and fed by gravity one at a time onto the tee. Also, suitable means are provided in easy reach of the batter for the batter to actuate after each practice hit in order to reload the tee with a new ball.

Accordingly, the present invention is directed to an automatic batting tee apparatus which comprises: (a) a housing having a top opening; (b) means for feeding balls one at a time to above the top opening; (c) an elongated drive member mounted upright in the housing for rotation about a vertical axis aligned with the top opening; (d) an elongated tube disposed upright in the housing surrounding the drive member and aligned with the top opening, the tube being drivingly engaged with the drive member and coupled to the housing so that in response to rotation of the drive member in one and the other of a pair of opposite rotational directions the tube will undergo upward and downward reciprocal movement along the vertical axis relative to the rotating drive member through a ball receiving and positioning cycle in which, as the drive member rotates in the one rotational direction, the tube is lowered to a ball receiving position for receiving and supporting a ball on the upper end of the tube and then, as the drive member rotates in the other rotational direction, the tube is raised to move the upper end of the tube supporting the ball through the top opening of the housing for positioning the ball in a ball hitting position spaced above the housing; and (f) drive means for rotating the drive member in the one and other of the pair of rotational directions to cause reciprocal movement of the tube through the ball receiving and positioning cycle.

More particularly, the housing has a base for resting on the ground and an enclosure supported at a bottom end portion on the base and extending upright therefrom to an open top end portion of the enclosure. The enclosure has a top cover defining a track extending in an inclined orientation from a side thereof to a top opening therein defining the top opening of the housing. The ball feeding means includes a chute mounted to the top cover and extending inclined outwardly and upwardly therefrom and a ball dispensing element movably mounted at a discharge end of the chute to undergo movement from an upright ball-blocking position to a depressed ball-releasing position and back to the upright position so as to permit the discharge of only one ball at a time from the chute into the track of the top cover.

The drive means includes an electrical power source, an electric motor connected to the electrical power source and having a rotary drive shaft, and a drive motion transmission coupling which drivingly interconnects the rotary drive shaft of the electric motor to the drive member. Actuation of the electric motor causing rotation of its drive shaft causes rotation of the drive member.

The automatic batting tee apparatus also comprises guide means stationarily mounted on the base of the housing for engaging the tube so as to prevent rotation of the tube with the rotation of the drive member. In response to rotation of the drive member in one and the other of the pair of opposite rotational directions, the tube is permitted by the guide means to undergo upward and downward reciprocal movement along the vertical axis relative to the rotating drive member through the ball receiving and positioning cycle.

The automatic batting tee apparatus also comprises drive control means for actuating the electric motor to cause rotating of the drive member and reciprocal movement of the tube through the ball receiving and positioning cycle. The drive control means includes an activation element disposed on the housing for actuation by a user. The activation element is a transducer adapted to generate an electrical signal in response to the user striking the transducer. The drive control means also includes a location sensing mechanism positioned adjacent to the tube and being operable to sense the arrival of the tube at vertically spaced lower and upper positions at which the tube terminates and changes the direction of its reciprocal movement through the ball receiving and positioning cycle. The drive control means further includes an electrical timer operable to cause a pause in the operation of the electric motor and thus in the reciprocal movement of the tube when it reaches the lower position in order to permit the transfer of a ball from the chute to the top cover, and an electronic controller programmed to control the operations of the timer and electric motor in response to the sensing the position of the tube by the location sensing mechanism and to activation of the transducer by the user.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
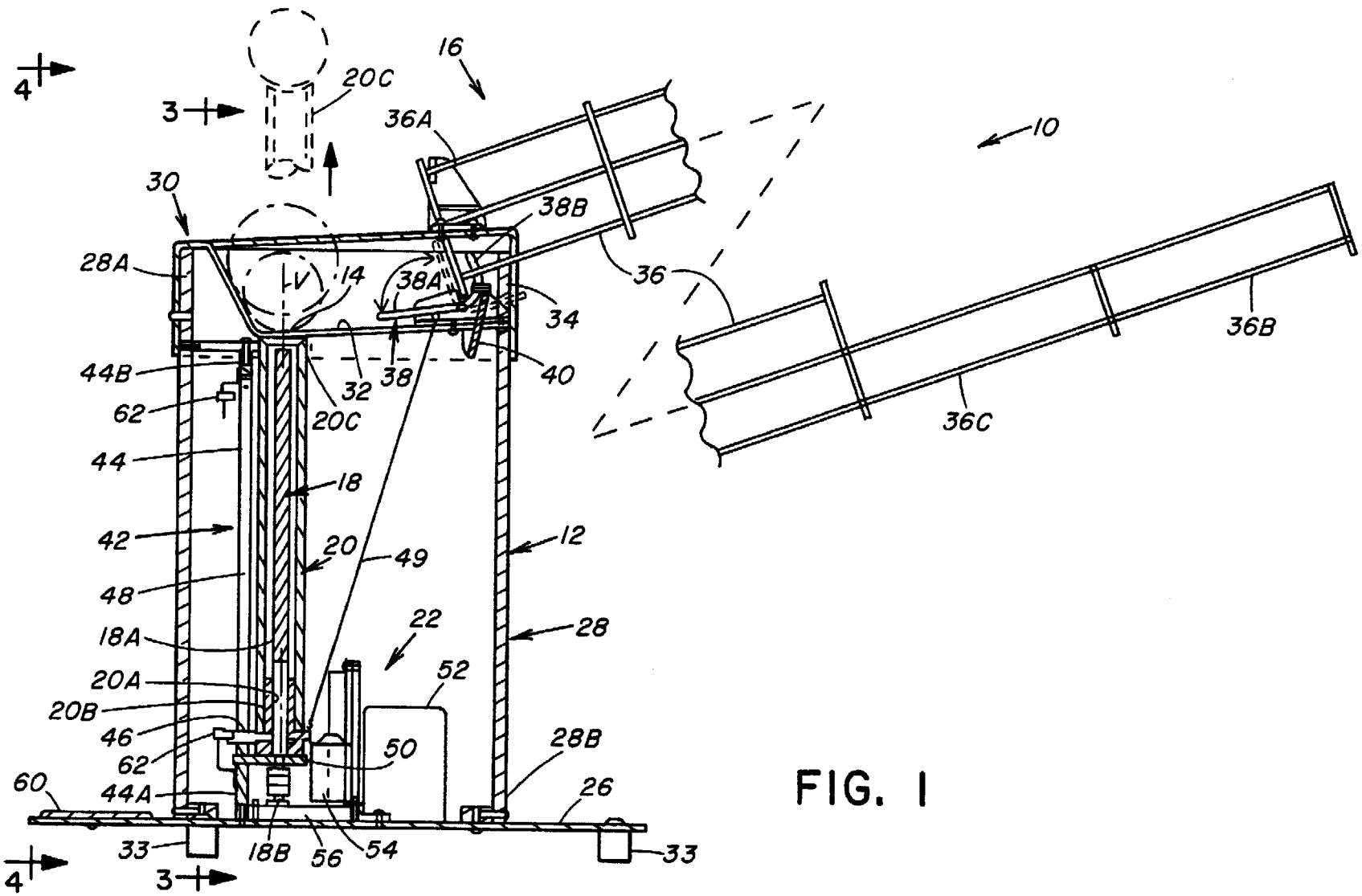
FIG. 1 is a side elevational view of an automatic batting tee apparatus of the present invention with a ball feeder chute of the apparatus being shown in a foreshortened form.

Referring to the drawings and particularly to FIGS. 1 to 4, there is illustrated an automatic batting tee apparatus, generally designated 10, of the present invention. The automatic batting tee apparatus 10 basically includes a housing 12 having a top opening 14, a ball feeding means 16 mounted to the housing 12 for feeding balls one at a time to above the top opening 14 thereof, an elongated drive member 18 mounted upright in the housing 12 for rotation about a vertical axis V aligned with the top opening 14, and an elongated tube 20 disposed upright in the housing 12 surrounding the drive member 18 and aligned with the top opening 14. The tube 20 is drivingly engaged with the drive member 18 and coupled to the housing 12 so that, in response to rotation of the drive member 18 in one and the other of opposite rotational directions, the tube 20 will undergo upward and downward reciprocal movement along the vertical axis V relative to the rotating drive member 18 through a ball receiving and positioning cycle. The apparatus 10 also includes drive means 22 for drivingly causing rotation of the drive member 18 in the one and other of a pair of opposite rotational directions to cause reciprocal movement of the tube 20 through the ball receiving and positioning cycle, and drive control means 24 for actuating the drive means 22 to cause rotating of the drive member 18 and reciprocal movement of tube 20 through the ball receiving and positioning cycle.

Figure 2:
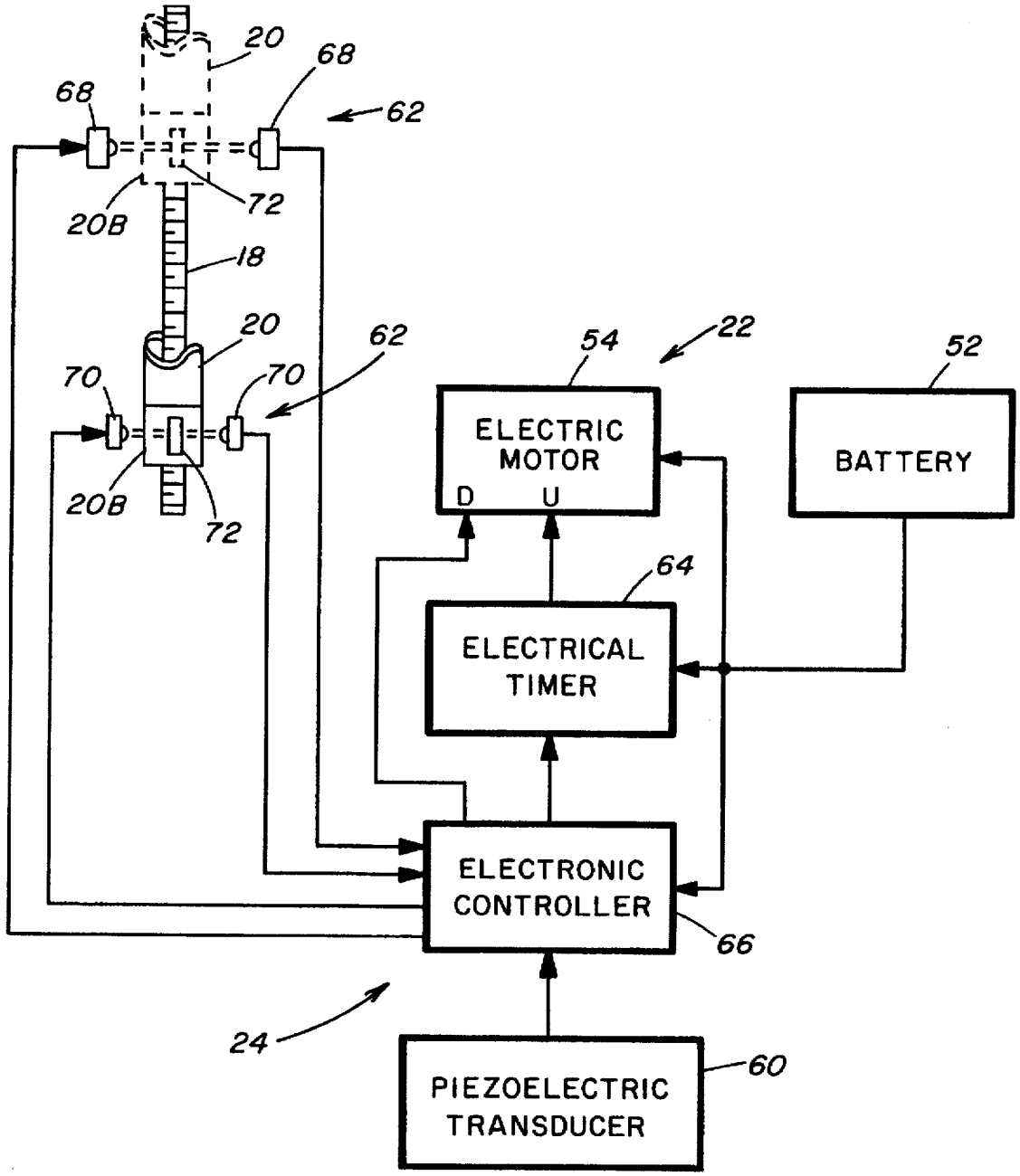
FIG. 2 is a diagram of the drive control means of the apparatus of FIG. 1.
Figure 3:
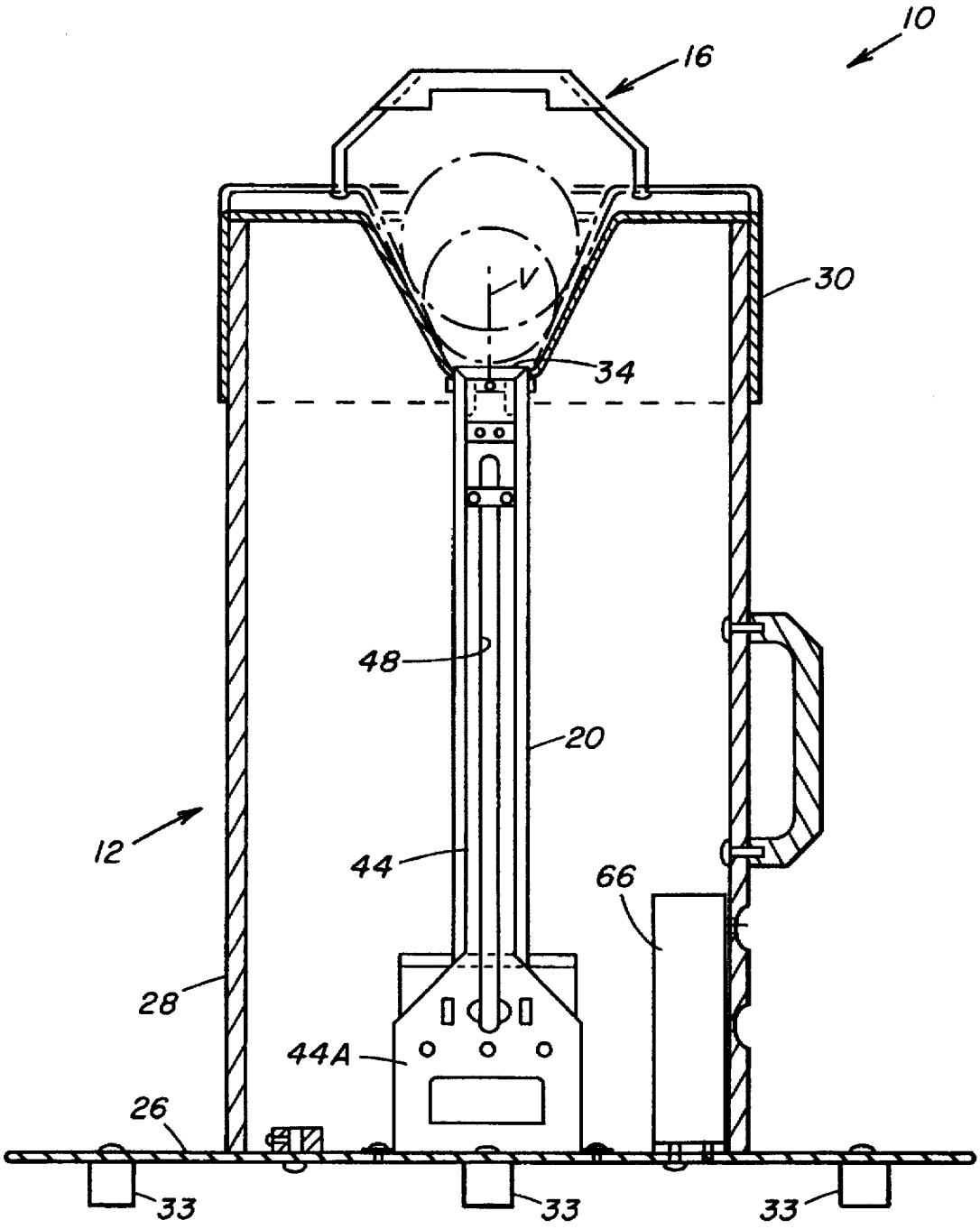
FIG. 3 is an enlarged side elevational of the apparatus taken along line 3—3 of FIG. 1 with portions of an enclosure of the apparatus being broken away to show the interior of the apparatus.

Referring to FIGS. 1–3, the housing 12 of the apparatus 10 includes a base 26 generally circular and flat in shape, an enclosure 28 in the form of an annular tubular sidewall generally cylindrical in shape and smaller in diameter than the base 26, and a top cover 30 fitted over an open top end portion 28A of the enclosure 28. The enclosure 28 is fixedly supported at a bottom end portion 28B on the base 26 and extends upright therefrom to the open top end portion 26A of the enclosure 26. The large flat base 26 rests on the ground so as to support the enclosure 28 in a stabilized upright fashion. The base 26 can be provided with a plurality of feet 33 for adjusting the height of the base 26 above the ground. The top cover 30 defines a recessed track 32 extending in an inclined orientation from a side opening 34 through the top end portion 28A of the enclosure 28 to the top opening 14 of the housing 12 defined in the top cover 30.

Figure 4:
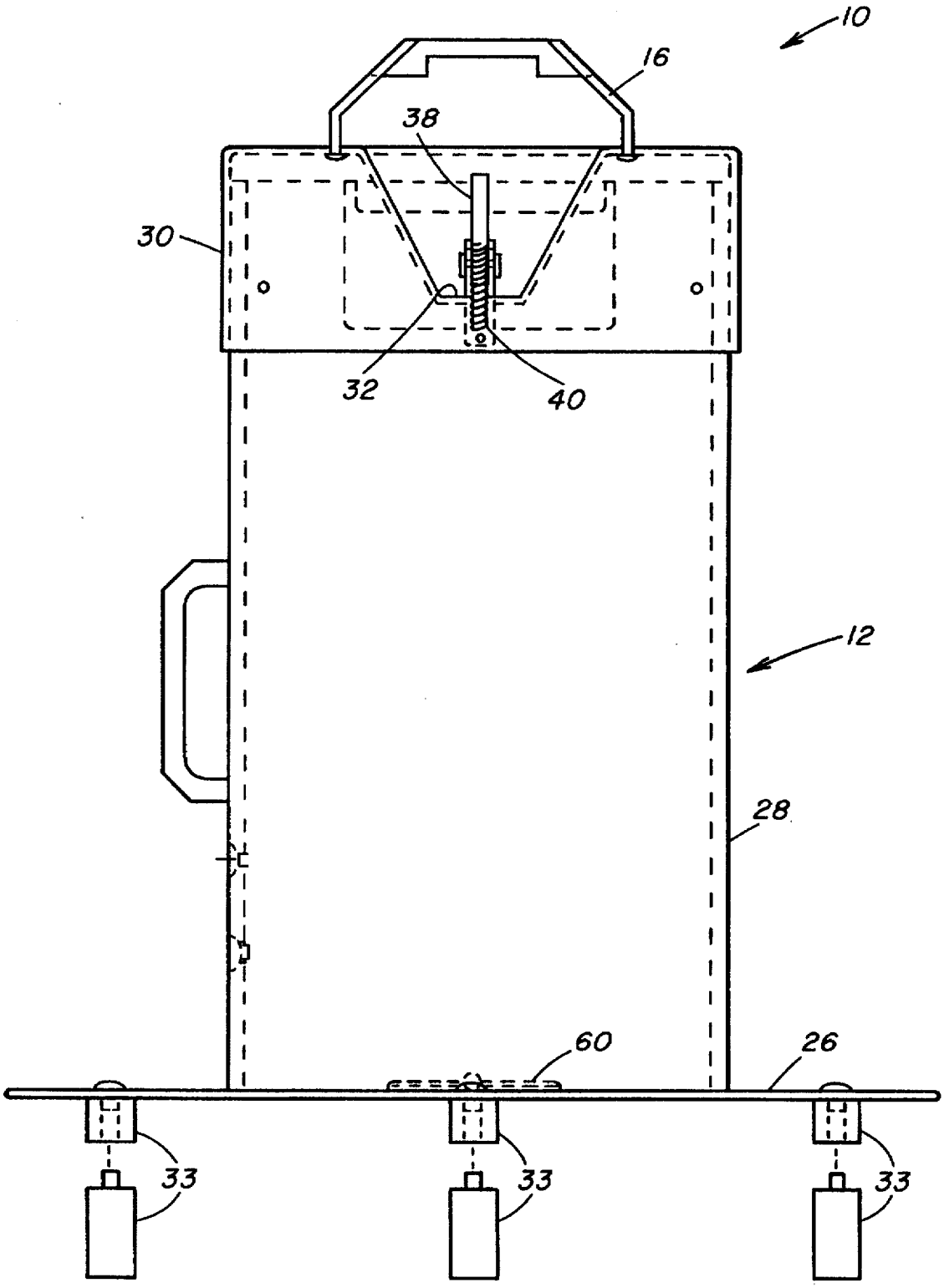
FIG. 4 is an opposite enlarged side elevational view of the apparatus taken along line 4—4 of FIG. 1.
Figure 6:
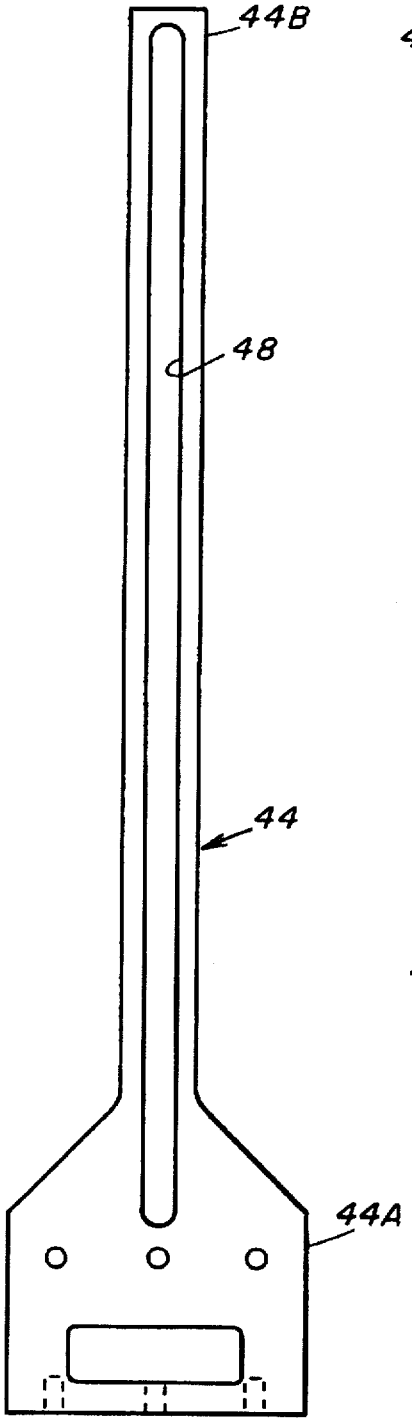
FIG. 6 is a side elevational view of the upright guide member as seen along line 6—6 of FIG. 5.

Referring to FIGS. 1, 3 and 4, the ball feeding means 16 of the apparatus 10 includes an elongated ball feeder chute 36 mounted at a discharge end 36A thereof to the top cover 30 and extending in inclined fashion outwardly and upwardly therefrom to an infeed end 36B of the chute 36, and a ball dispensing element 38 being generally L-shaped and movably mounted at the discharge end 36A of the chute 36. The infeed end 36B of the chute 36 is disposed remote from the top cover 30 for receiving balls one at a time. The discharge end 36A of the chute 36 is disposed adjacent to the inclined track 32 of the top cover 30 for feeding balls through the side opening 34 of the top end portion 28A of the enclosure 28. The infeed end 36B and discharge end 36A of the chute 36 are interconnected by an elongated ball transfer portion 36C of the chute 36 for guiding balls in a row from the infeed end 36B to the discharge end 36A of the chute 36. The ball dispensing element 38 is pivotally mounted at the discharge end 36A of the chute 36 to undergo movement from an upright ball-blocking position in which the longer leg 38A of the dispensing element 38 blocks the path of the row of balls in the chute 36 to a depressed ball-releasing position in which the longer leg 38A unblocks the path of the balls while the shorter leg 38B of the dispensing element 38 temporarily blocks all of the balls except the leading one allowing the latter to roll onto and down the track 32 to the top opening 14 of the housing 12. A coil spring 40 attached to and extending between the top cover 30 and the shorter leg 38B of the L-shaped dispensing element 38 imposes a biasing force thereon which causes it to return to its upright position after discharge of only one ball at a time from the chute 36 into the track 32 of the top cover 30 during each ball receiving and positioning cycle of the apparatus 10.

Referring to FIGS. 1, 3, 5 and 6, the elongated drive member 18 of the apparatus 10 is preferably a drive screw member having external screw threads 18A which are threadably engaged with internal screw threads 20A on a lower end portion 20B of the tube 20. The drive screw member 18 is rotatably mounted at its lower end 18B in the enclosure 28 for rotation about the vertical axis V aligned with the top opening 14 of the top cover 30. The elongated tube 20 of the apparatus 10, which is hollow and made of a suitable flexible material such as rubber, is mounted in the enclosure 28 surrounding the drive screw member 18 and also aligned with the top opening 14 of the top cover 30.

The apparatus 10 also includes guide means 42 fixedly and stationarily mounted to the base 26 of the housing 12 adjacent to but spaced laterally from the elongated hollow tube 20. The guide means 42 includes an upright guide member 44 and a guide element 46. The upright guide member 44 is stationarily disposed in the enclosure 28 adjacent to but laterally spaced from the hollow tube 20 and fixedly mounted at a lower end 44A on the base 26. The upright guide member 44 has an elongated channel or groove 48 extending generally parallel to the vertical axis V between lower and upper ends 44A, 44B of the guide member 44. The guide element 46 is in the form of a pin attached to the lower end portion 20B of the hollow tube 20 and projecting laterally therefrom into the groove 48 of the upright guide member 44 so as to prevent rotation of the hollow tube 20 with rotation of the drive screw member 18. With rotation of the tube 20 prevented by the extension of the guide pin element 46 into the groove 48 of the upright guide member 44, the only movement that is permitted is upward and downward vertical reciprocal movement of the guide element 46 along the groove 48 and of the hollow tube 20 along vertical axis V relative to the rotating drive screw member 18 through the ball receiving and positioning cycle. The longer leg 38A of the ball dispensing element 38 is connected to the lower end portion 20B of the tube 20 by an elongated flexible inelastic string-like element 49, such as a cord or chain, so that when the tube 20 is lowered to a lower ball receiving position the ball dispensing element 38 will be pulled and pivoted counterclockwise to the depressed ball-releasing position shown in solid line form in FIG. 1. On the other hand, when the tube 20 is raised to an upper ball hitting position the ball dispensing element 38 will be released and allowed to pivot clockwise under the influence of the coil spring 40 back to the upright ball-blocking position shown in dashed line form in FIG. 1.

Thus, the drive screw member 18, which is rotatably mounted and supported upright by a bracket 50 fixedly attached to the lower end 44A of the guide member 44, can be rotated by the drive means 22 in one or the other of a pair of opposite rotational directions. However, because of the guide means 42, the tube 20 is permitted only and guided to undergo upward and downward linear reciprocal movement along the vertical axis V relative to the rotating drive screw member 18. As the drive screw member 18 is rotated in one rotational direction, the hollow tube 20 will be lowered to the ball receiving position, as shown in solid line form in FIGS. 1, 3 and 5, for receiving and supporting a ball on the upper end 20C of the hollow tube 20. Then, as the drive screw member 18 is rotated in the other rotational direction, the hollow tube 20 will be raised, moving the upper end 20C thereof supporting the ball through the top opening 14 of the top cover 30 for positioning the ball in the ball hitting position spaced above the cover 30, as shown in dashed line form in FIG. 1.

Figure 5:
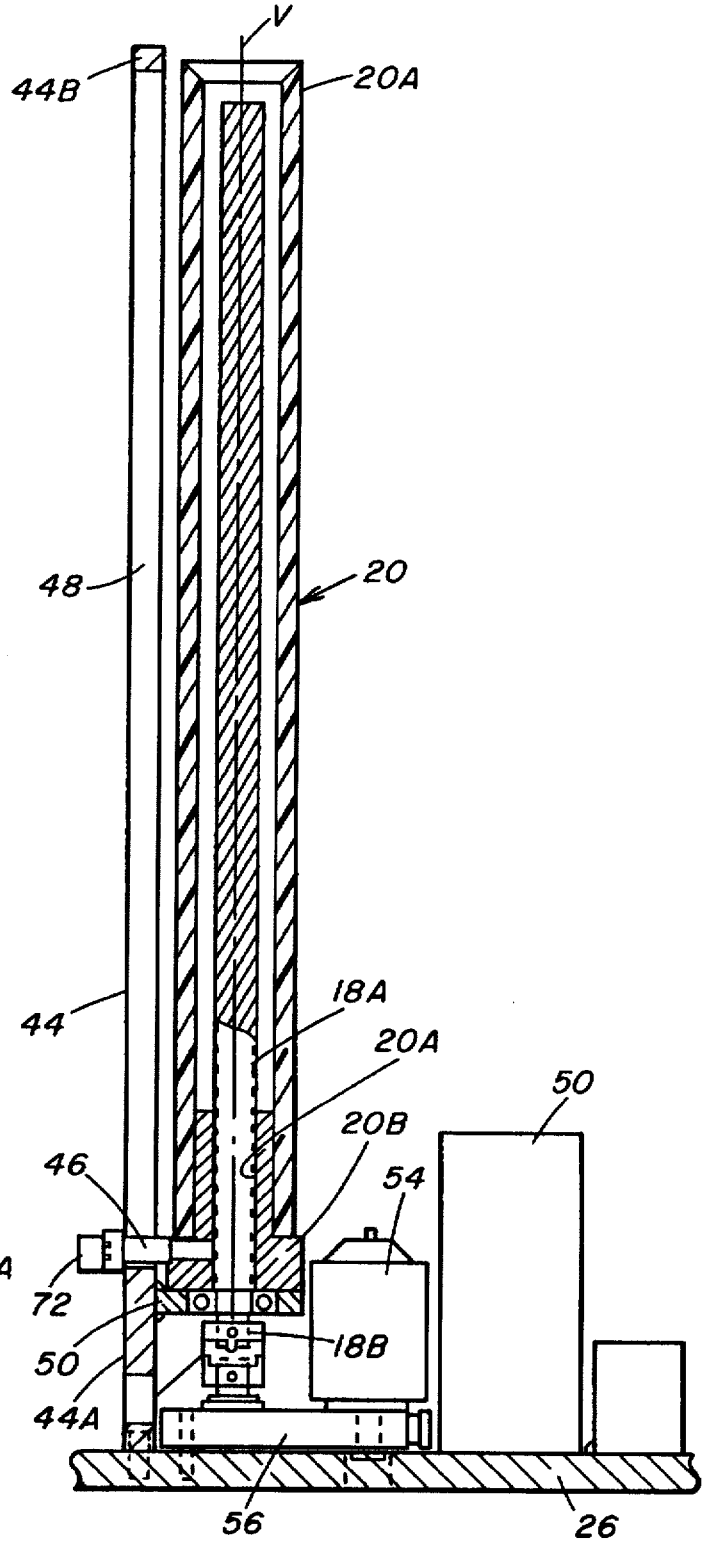
FIG. 5 is an enlarged elevational view of an upright guide member and elongated drive screw member disposed in the enclosure of the apparatus.

Referring to FIGS. 1 and 5, the drive means 22 of the apparatus 10 is mounted on the base 26 in the enclosure 28 adjacent and coupled to the drive screw member 18 and is operable for rotating the drive screw member 18 in the pair of opposite rotational directions to cause upward and downward reciprocal movement of the tube 20 through the ball receiving and positioning cycle. The drive means 22 preferably includes a source 52 of electrical power, such as a 12 volt d.c. battery, an electric motor 54 connected to the battery 52, and a drive motion transmission coupling 56, such as a gearbox. The electric motor 54 has a rotary output drive shaft 58 and the drive motion transmission coupling 56 drivingly interconnects the rotary drive shaft 58 of the electric motor 54 to the lower end 18B of the drive screw member 18 such that actuation of the electric motor 54 causing rotation of its drive shaft 58 causes rotation of the drive screw member 18 and thereby reciprocal movement of the tube 20.

Referring to FIGS. 1 and 2, the drive control means 24 of the apparatus 10 is provided to control actuating the above-described drive means 22 to cause rotation of the drive screw member 18 and reciprocal movement of the tube 20 through the ball receiving and positioning cycle. More particularly, the drive control means 24 includes an activation element 60, a location sensing mechanism 62, an electrical timer 64 and an electronic controller 66. The electrical timer 64 is operable for causing a pause in the operation of the electric motor 54 and thus in the reciprocal movement of the tube 20 when it reaches the lower ball-receiving position in order to permit the transfer of a ball from the chute 36 to the above the top opening 14 of the top cover 30. The electronic controller 66 is pre-programmed in a manner conventionally practiced by those skilled in software and programming arts to control the operations of the electrical timer 64 and electric motor 54 in response to activation of the activation element 60 by the user and to the positions of the tube 20 sensed by the location sensing mechanism 62.

The activation element 60 is disposed on the exterior of the base 26 of the housing 12 for actuation by a user to activate the electronic controller 66 to initiate operation of the electric motor 54 to rotate its drive shaft 58 and thereby the drive screw member 18 in one rotational direction and move the tube 20 through a downward stroke of the ball receiving and positioning cycle. The activation element 60 is preferably, but not necessarily, a piezoelectric transducer being known per se to generate an electrical signal in response to the user physically tapping on it, such with the ball bat.

The location sensing mechanism 62 preferably, but not necessarily, includes upper and lower pairs of electro-optical sensors 68, 70 positioned adjacent to the tube 20 respectively at upper and lower vertically spaced positions, as seen in FIG. 1, where the tube 20 is to terminate and change the direction of its reciprocal movement through the ball receiving and positioning cycle. The location sensing mechanism 62 also includes a flag-like element 72 attached to and projecting outwardly from the guide pin element 46. Upon arrival of the lower end portion 20B of the tube 20 at a respective one of the respective upper and lower positions between the electro-optical sensor pair 68 located at the respective position, the flag-like element 70 intersects and blocks the transmission of a light beam between the respective electro-optical sensors 68 which, in turn, signals the electronic controller 66 to terminate the operation of the electric motor 54 if the signal was received from the upper pair of optical-sensors 68 and to activate the electrical timer 64 to cause a pause in operation of the electric motor 54 to permit loading of the ball and then at the end of the pause reverse the direction of operation of the motor 54 and rotation of the drive screw member 18 if the signal was received from the lower pair of electro-optical sensors 70.

The apparatus 10 thus operates as follows. The tube 20 being located at the upper ball hitting position is first caused to retract into the housing 12 and thus lower to the lower ball receiving position by the user merely tapping on the piezoelectric transducer 60. Such tapping on the transducer 60 produces and transmits an electrical signal to the electronic controller 66 which initiates it to actuate rotation of the electric motor 54 and of drive screw member 18 in the one rotational direction which will move the tube 20 downward. Upon the downwardly-moving tube 20 reaching the lower position, the lower pair of electro-optical sensors 70 sense the arrival of the tube 20 and so signal the electronic controller 66 which then actuates the electric motor 54 and drive screw member 18 to cease rotation and pause for a short time as measured by operation of the timer 64 to allow the next or lead ball in the chute 36 to be transferred onto the top cover 30 to above the top opening 14 of the housing 12 in position for receiving and supporting the ball on the upper end 20C of the tube 20 when the tube 20 commences its upward movement. Then, after expiration of the timer 64, the electronic controller 66 commences the rotation of the electric motor 54 and drive screw member 18 in the reverse or other rotational direction, causing the tube 20 to be raised, moving upwardly through the top opening 14 of the enclosure 28, until the lower end portion 20B of the tube 20 reaches the upper position of the upper pair of electro-optical sensors 68 and the upper end 20C of the tube 20 carrying the ball reaches concurrently the upper ball hitting position spaced above the housing 12. The upper pair of electro-optical sensors 68 signal the electronic controller 66 which then terminates the rotation of the electric motor 54 and drive screw member 18 and thereby the upward movement of the tube 20. The cycle is restarted by the user again tapping on the piezoelectric transducer activation element 60.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. An automatic batting tee apparatus, comprising:

(a) a housing having a top opening;

(b) means for feeding balls one at a time to above said top opening of said housing;

(c) an elongated drive member mounted upright in said housing for rotation about a vertical axis aligned with said top opening of said housing;

(d) an elongated tube disposed upright in said housing surrounding said drive member and aligned with said top opening of said housing, said tube being drivingly engaged with said drive member and coupled to said housing so that in response to rotation of said drive member in one and the other of a pair of opposite rotational directions said tube will undergo upward and downward reciprocal movement along said vertical axis relative to said rotating drive member through a ball receiving and positioning cycle in which as said drive member rotates in said one rotational direction said tube is lowered to a ball receiving position for receiving and supporting a ball on said upper end of said tube and then as said drive member rotates in said other rotational direction said tube is raised to move said upper end of said tube supporting the ball through said top opening of said housing for positioning the ball in a ball hitting position spaced above said housing; and (e) drive means for rotating said drive member in said one and other of said pair of rotational directions to cause reciprocal movement of said tube through said ball receiving and positioning cycle.

2. The apparatus of claim 1 wherein said housing includes:

a base for resting on the ground; and an enclosure supported at a bottom end portion on said base and extending upright therefrom to an open top end portion of said enclosure.

3. The apparatus of claim 2 wherein said enclosure includes:

an annular sidewall having said open top end portion; and a top cover fitted over said open top end portion of said annular sidewall and defining a track extending in an inclined orientation from a side opening in said top end portion of said sidewall to an top opening in said top cover defining said top opening of said housing.

4. The apparatus of claim 1 wherein said ball feeding means includes a ball feeder chute mounted to said housing and extending inclined outwardly and upwardly therefrom, said chute having a discharge end located adjacent to said top cover.

5. The apparatus of claim 4 wherein said ball feeding means also includes a ball dispensing element pivotally mounted at a discharge end of said chute for undergoing movement from an upright ball-blocking position to a depressed ball-releasing position and back to said upright ball-blocking position so as to permit discharge of only one ball at a time from said chute to above said top opening of said housing during each ball receiving and positioning cycle.

6. The apparatus of claim 1 wherein said drive means includes:

an electrical power source;

an electric motor having a rotary drive shaft and being connected to said electrical power source; and a drive motion transmission coupling drivingly interconnecting said rotary drive shaft of said electric motor to said drive member such that rotation of said rotary drive shaft of said electric motor causes rotation of said drive member.

7. The apparatus of claim 1 further comprising:

drive control means for actuating said drive means to cause rotation of said drive member and reciprocal movement of said tube through said ball receiving and positioning cycle.

8. The apparatus of claim 7 wherein said drive control means includes an activation element in the form of a transducer disposed on said housing and adapted to generate an electrical signal in response to the user striking said transducer.

9. The apparatus of claim 8 wherein said drive control means further includes a location sensing mechanism positioned adjacent to said tube and being operable to sense the arrival of said tube at vertically spaced lower and upper positions at which said tube terminates and changes direction of its reciprocal movement through said ball receiving and positioning cycle.

10. The apparatus of claim 9 wherein said drive control means also includes an electrical timer operable to cause a pause in operation of said drive means and thereby a pause in the rotation of said drive member and in the reciprocal movement of said tube when said tube reaches said lower position in order to permit transfer of a ball from said discharge end of said chute to above said top opening of said housing.

11. The apparatus of claim 10 wherein said drive control means further includes an electronic controller programmed to control operation of said timer and said drive means in response to the position of said tube sensed by said location sensing mechanism and in response to activation of said transducer by the user.

12. An automatic batting tee apparatus, comprising:

(a) a housing having a top opening;

(b) means for feeding balls one at a time to above said top opening of said housing;

(c) an elongated drive screw member mounted upright in said housing for rotation in one and the other of a pair of opposite rotational directions about a vertical axis aligned with said top opening of said housing, said drive screw member having external screw threads;

(d) an elongated tube disposed upright in said housing surrounding said drive screw member and aligned with said top opening of said housing, said tube having a lower end with internal screw threads threadably engaged with said external screw threads of said drive screw member;

(e) guide means in said housing for engaging said tube so as to prevent rotation of said tube with rotation of said drive screw member and in response to rotation of said drive screw member in one and the other of a pair of opposite rotational directions guide upward and downward reciprocal movement of said tube along said vertical axis relative to said rotating drive screw member through a ball receiving and positioning cycle in which, as said drive screw member rotates in said one rotational direction, said tube is lowered to a ball receiving position for receiving and supporting a ball on said upper end of said tube and then, as said drive screw member rotates in said other rotational direction said tube is raised to move said upper end of said tube supporting the ball through said top opening of said housing for positioning the ball in a ball hitting position spaced above said housing;

(f) drive means for rotating said drive screw member in said one and other of said pair of rotational directions to cause reciprocal movement of said tube through said ball receiving and positioning cycle; and (g) drive control means for actuating said drive means to cause rotation of said drive screw member and reciprocal movement of said tube through said ball receiving and positioning cycle.

13. The apparatus of claim 12 wherein said guide means includes:

a guide member stationarily mounted upright in said housing laterally from and adjacent to said tube and having an elongated groove extending between upper and lower ends of said guide member; and a guide element attached to said tube and extending laterally therefrom into said groove defined in said guide member so as to prevent rotation of said tube upon rotation of said drive screw member and thereby cause said upward and downward reciprocal movement of said tube relative to said drive screw member through said ball receiving and positioning cycle.

14. The apparatus of claim 12 wherein said housing includes:

a base for resting on the ground; and an enclosure supported at a bottom end portion on said base and extending upright therefrom to an open top end portion of the enclosure.

15. The apparatus of claim 14 wherein said enclosure includes:

an annular sidewall having said open top end portion; and a top cover fitted over said open top end portion of said annular sidewall and defining a track extending in an inclined orientation from a side opening in said top end portion of said sidewall to an top opening in said top cover defining said top opening of said housing.

16. The apparatus of claim 15 wherein said ball feeding means includes a ball feeder chute mounted to said top cover and extending inclined outwardly and upwardly therefrom, said chute having a discharge end located adjacent to said top cover.

17. The apparatus of claim 16 wherein said ball feeding means also includes a ball dispensing element movably mounted at said discharge end of said chute for undergoing movement from an upright ball-blocking position to a depressed ball-releasing position and back to said upright ball-blocking position so as to permit discharge of only one ball at a time from said chute into said track of said top cover during each ball receiving and positioning cycle.

18. The apparatus of claim 12 wherein said drive means includes:

an electrical power source;

an electric motor having a rotary drive shaft and being connected to said electrical power source; and a drive motion transmission coupling drivingly interconnecting said rotary drive shaft of said electric motor to said drive screw member such that rotation of said rotary drive shaft of said electric motor causes rotation of said drive screw member.

19. The apparatus of claim 12 wherein said drive control means includes an activation element in the form of a piezoelectric transducer disposed on said housing and adapted to generate an electrical signal in response to the user striking said transducer.

20. The apparatus of claim 19 wherein said drive control means further includes a location sensing mechanism positioned adjacent to said tube and being operable to sense the arrival of said tube at vertically spaced lower and upper positions where said tube terminates and changes direction of its reciprocal movement through said ball receiving and positioning cycle.

21. The apparatus of claim 20 wherein said drive control means also includes an electrical timer operable to cause a pause in operation of said drive means and thereby a pause in the rotation of said drive screw member and in the reciprocal movement of said tube when said tube reaches said lower position in order to permit transfer of a ball from said discharge end of said chute to above said top opening of said housing.

22. The apparatus of claim 21 wherein said drive control means further includes an electronic controller programmed to control operation of said timer and said drive means in response to the position of said tube sensed by said location sensing mechanism and in response to activation of said piezoelectric transducer by the user.

* * * * *